US005700433A

United States Patent [19]

Somary

[11] Patent Number: 5,700,433

[45] Date of Patent: Dec. 23, 1997

[54] ROTARY VALVE FOR REGENERATIVE THERMAL OXIDIZER

[75] Inventor: Geoffrey Somary, Arlington Heights, Ill.

[73] Assignee: Eisenmann Corporation, Crystal Lake, Ill.

[21] Appl. No.: 604,168

[22] Filed: Feb. 21, 1996

[51] Int. Cl.[6] ..... B01D 50/00

[52] U.S. Cl. ..... 422/171; 422/173; 422/175; 422/198; 422/206; 432/180; 432/181; 432/72; 110/211; 431/5

[58] Field of Search ..... 422/171, 173, 422/175, 198, 206; 432/180, 181; 251/304, 307; 137/311, 309; 110/211; 431/5

[56] References Cited

U.S. PATENT DOCUMENTS 5,016,547 5/1991 Thomason .
5,134,945 8/1992 Reimlinger et al. ..... 110/304
5,460,789 10/1995 Wilhelm ..... 422/173
5,540,584 7/1996 Greco ..... 432/181
5,562,442 10/1996 Wilhelm ..... 432/72

OTHER PUBLICATIONS

"Eisenmann Umwelttechnik" UT-22 Sales Document and certified translation thereof.

*Primary Examiner*—Christopher Kim
*Attorney, Agent, or Firm*—Lee, Mann, Smith, McWilliams, Sweeney & Ohlson

[57] ABSTRACT

There is disclosed herein a system for use in a regenerative thermal oxidizer to position a rotatable valve body relative to a lower fixed surface and an upper surface and support the valve body from the lower surface. However, the support and positioning provides for sealing engagement between the body and the upper and lower surfaces. A plurality of assemblies, each secured to the lower surface engage an external and circumferential support flange on the valve body for accomplishing the support and positioning.

9 Claims, 2 Drawing Sheets

ROTARY VALVE FOR REGENERATIVE THERMAL OXIDIZER

BACKGROUND OF THE INVENTION

This invention relates to a regenerative thermal oxidizer, and more particularly to a rotatable valve body employed in such oxidizer.

A regenerative thermal oxidizer (RTO) is a unit for the treatment of polluted industrial gases so as to clean the polluted gas for eventual release to the environment. Gas treatment or regenerative thermal oxidizers are shown in U.S. patents such as U.S. Pat. Nos. 5,460,789 and 5,016,547 and German literature entitled "Eisenmann Umwelttechnik UT 22".

One type of commercially available unit includes a rotary valve positioned in a housing for distributing incoming polluted gas to various positions within the oxidizer for treatment and for distribution of treated gas to various outlets from the oxidizer.

The valve includes a cylindrically-shaped body which rotates about a cylinder axis, directs the flow of various gases within the oxidizer, and rests on a lower fixed surface which carries the valve body and acts as gas manifold. The valve body rotates on the fixed surface and forms a seal therewith. The top of the valve body rotates against and seals against an upper surface which cooperates in directing the flow of incoming and treated gas to and from the rotary valve.

Due to the heavy weight of the valve body it has been found to wear the lower fixed surface. This could potentially create a gap between the upper surface of valve body and the upper surface. In otherwords, this wear could produce seal failure or undesirable gas leakage at the upper interface or seal.

It is the object of this invention to provide a mechanism for use with a rotatable valve body used in an oxidizer to reduce or prevent wear to the lower surface and to assure sealing at the top surface.

SUMMARY OF THE INVENTION

The structure of this invention meets the problems discussed hereinbefore. The valve body of this invention includes a radially projecting circumferential support or flange. A roller mechanism is provided which is supported by the fixed lower surface, extends upwardly and engages the bottom of the flange. A plurality of these roller mechanisms are circumferentially spaced about the body and thus support the valve body by exerting an upward force on the flange that reduces the contact between the body and the fixed lower surface. The extent of the roller's upward positioning, and thus the weight exerted by the body on the lower surface can be controlled.

Very importantly, there is also provided a mechanism by which the seal between the upper plate assembly and the upper surface of the rotating valve body is controlled and maintained. The mechanism includes an adjustable roller that engages the top of the flange opposite the lower roller to maintain the position of the flange in a horizontal plane and thus positions the valve body relative to the upper surface and the lower fixed surface. To assist in this positioning the upper plate assembly is positioned relative to the lower surface.

DESCRIPTION OF THE PREFERRED EMBODIMENT

IN GENERAL

Figure 1:
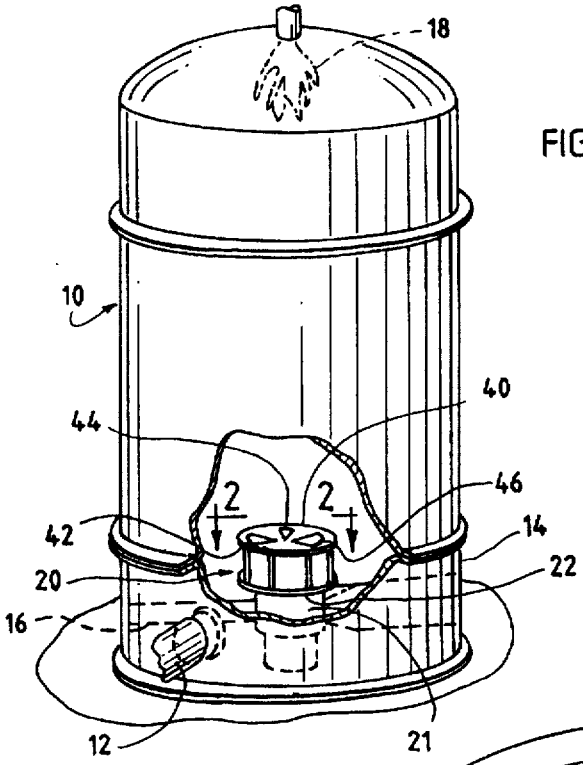
FIG. 1 is a perspective view of a regenerative thermal oxidizer with part of the exterior wall broken away to show in a diagrammatic way a rotary valve body.

Referring now to FIG. 1 there is shown a regenerative thermal oxidizer 10, which includes an incoming gas inlet 12, an outgoing gas outlet 14 and a purge gas outlet 16, all of which are in the oxidizer's lower portion. A combustion chamber is provided at the top of the oxidizer as suggested by the flame 18.

A rotary valve or distributor 20 is positioned in the lower portion of the oxidizer (1) for receiving incoming gas and distributing it within the oxidizer and (2) for receiving treated gas and distributing it to the outgoing gas outlet 14 and purge gas outlet 16. As can be seen the valve body 20 rests on a lower housing 21 which has a lower fixed surface 22 which acts as the lower bearing surface against which the valve body rotates. The lower housing 21 acts as a manifold for distributing gas and from the rotary distributor to the outlets 14 and 16.

Figure 2:
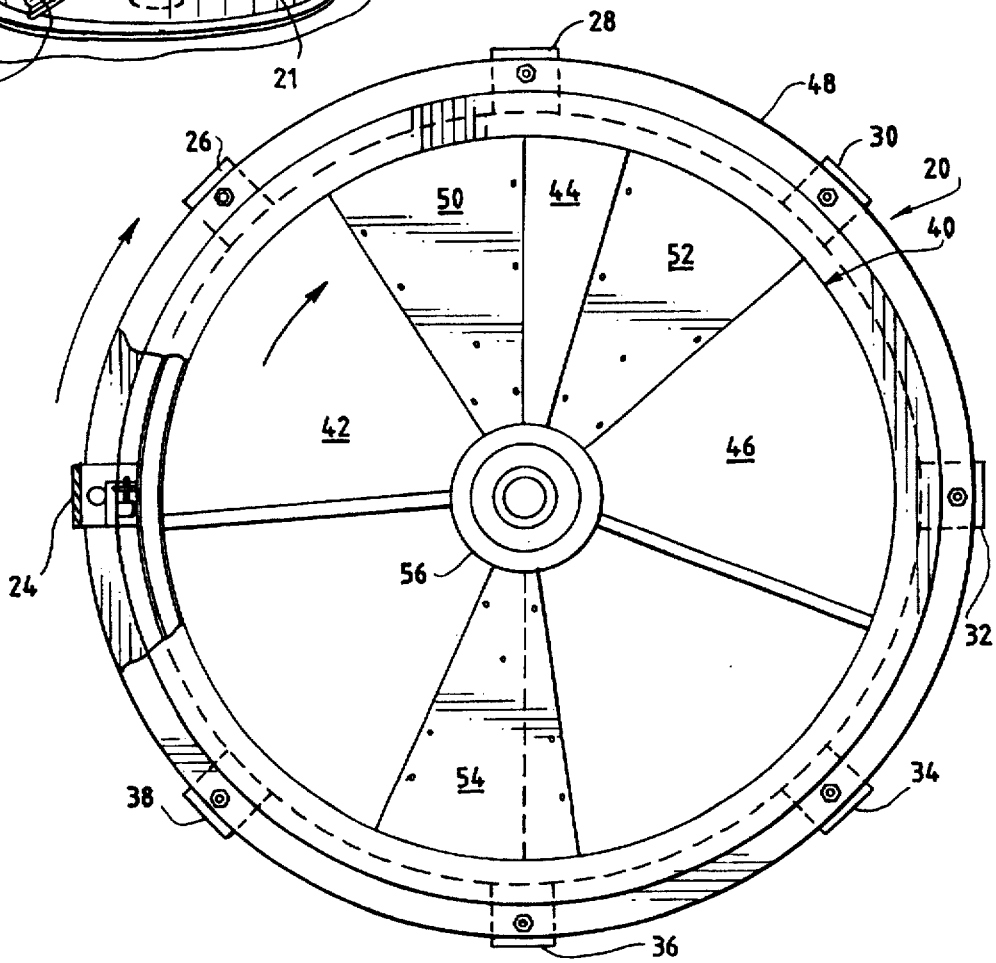
FIG. 2 is a top or plan view of the valve body shown in FIG. 1 and a distribution or shutter plate that forms the top of the body.

Referring now to FIG. 2 the valve body 20 is seen in a top or plan view. In that view it can be seen that a number of support and adjustment assemblies 24, 26, 28, 30, 32, 34, 36, and 38 are circumferentially arranged around the valve body. In this case there are eight (8) and it is appreciated that it could be more.

Looking at the valve body it is seen that the top is a plate-like member 40 (which is sometimes referred to as a shutter), which includes apertures 42, 44 and 46 that cooperate in distributing and receiving gas. The plate 40 also forms the exterior circumferential support flange 48, the pie-shaped webs or aperture forming members 50, 52 and 54 and the center rotation member 56. The apertures 42, 44 and 46 are formed by the webs 50, 52 and 54 and are aligned with specific portions of the rotary valve body positioned therebelow. However, the weight of the valve body is supported by the adjustment assemblies 24–38 which engage the flange as will be seen hereinafter and the lower surface 22.

Figure 3:
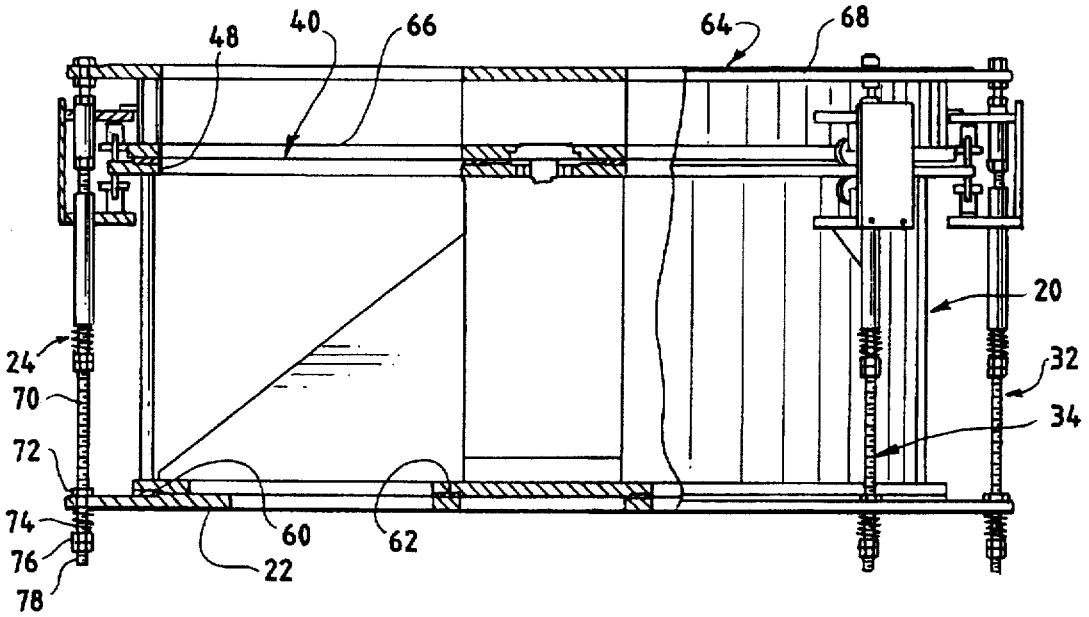
FIG. 3 is a side or elevational view of the valve body, with a portion of a side broken away and showing three (3) valve body adjustment and support mechanisms.
Figure 4:
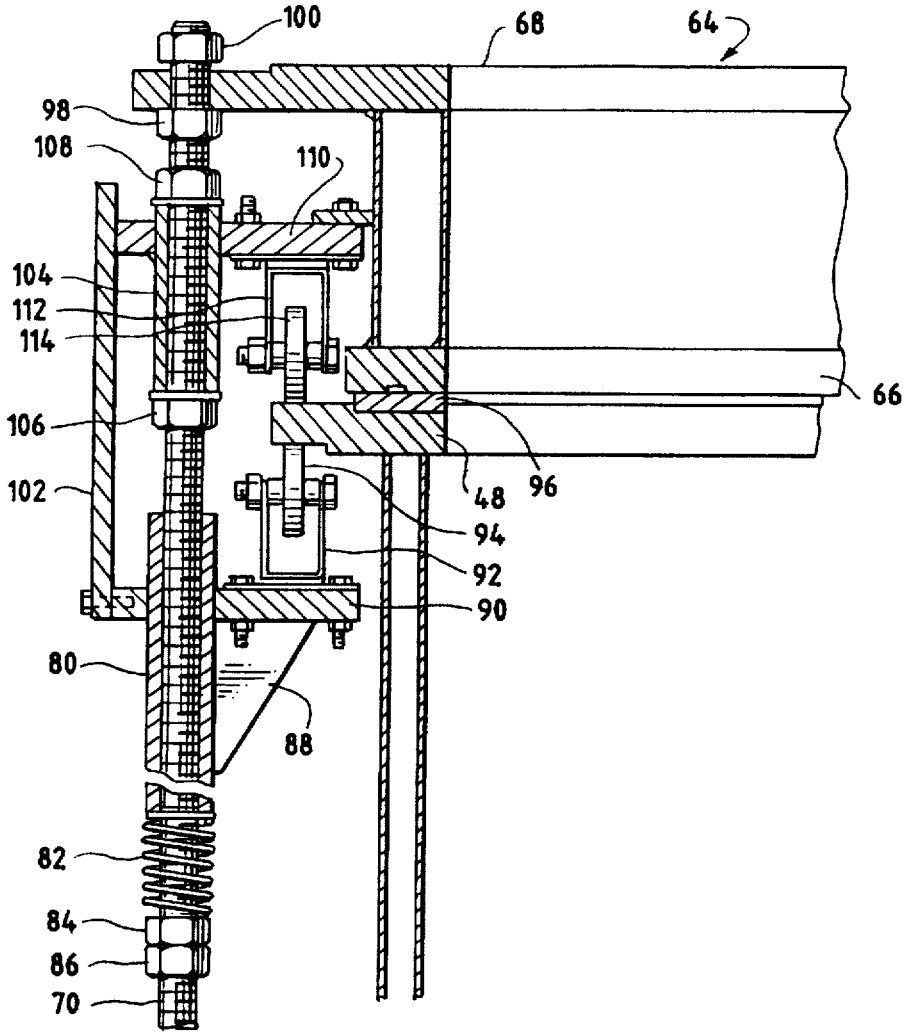
FIG. 4 is an enlarged and sectional view of the adjustment and support mechanism shown in the upper left hand portion of FIG. 3.

Referring now to FIG. 3, the body 20 generally is shown and includes the aperture plate 40, which also defines the radially extending circumferential support flange 48. The valve body rests on a lower fixed surface 22, which provides support for the valve body and carries seals such as 60 and 62. There is also provided the upper plate assembly 64, which includes surface 66 which the plate 40 engages.

The valve body 20 is supported in relation to the lower fixed surface 22 and the upper plate assembly 64. This support is provided by the adjustment assemblies 24–38. Each of the assemblies is essentially identical. As can been seen in FIG. 3. Each assembly includes an elongated rod, such as 70, that is positioned relative to the lower fixed surface 22 by an upper nut 72 that engages the upper side of the surface 22 and a compression spring 74 surrounding about the rod, engaging the lower side of the surface 22 and held in position by the nuts 76 and 78. The rod extends upwardly to a lower roller assembly as described hereinafter.

The lower roller assembly includes a sleeve 80 that surrounds or rides on the threaded rod and is held in position by a compression spring 82 that surrounds the rod and engages the lower portion of the sleeve and the nuts 84 and 86 which engage a threaded rod. The nuts 84 and 86 and spring 82 define a lower position for the sleeve 80.

A lower roller support structure is secured to the sleeve 80. That structure includes a web 88 that is secured to the sleeve 80 and to an apertured plate or stage 90 that extends about the sleeve 80. A roller support bracket 92 is secured to the plate 90 and a lower roller 94 is secured to the bracket 92. It is seen that the roller 94 engages the bottom of flange 48 and the flange and the body therebelow are at least in part supported and carried by the roller 94 through bracket 92, plate 90, web 88, sleeve 80, threaded rod 70, nut 72 and lower surface 22. Thus, by adjusting the height of the lower rollers the positioning of the flange and valve body relative to the lower fixed surface 22 is adjusted.

It is seen that the flange 48 also seals at seal 96 to the upper assembly 64 and to the bottom plate 66. The upper assembly 64 is positioned in relation to the lower fixed surface 22 by the rod 70, which extends upwardly and engages the top plate 68 via the lower nut 98 and the upper nut 100. Thus the upper assembly 64 is flexibly positioned relative to the lower fixed surface 22 and the valve body 20 is also positioned relative to lower surface 22. Thus, the valve by and upper assembly are positioned relative to each other.

This type of positioning, in general, is a broad or coarse type of positioning generally positioning the valve body 20 and upper fixed plate 64 relative to each other. The specific flange position relative to the upper plate is accomplished by a upper adjustment mechanism.

It is seen that the side guide plate 102 is secured to and extends upwardly from the stage 90 and is positioned radially outwardly of the roller 94. The plate 102 is in effect a guide or positioning member. A second sleeve 104 is positioned around the threaded rod 70 and a lower nut 106 is provided which engages the rod and the lower end of the sleeve. The upper end of the sleeve is held in position by the nut 108. Secured to the sleeve 104 is an upper roller assembly which includes an upper stage 110 that is secured to the sleeve 104 and engages the side guide plate 102 as well as the side of the upper assembly 64. In this way, as the sleeve 104 is adjusted upwardly or downwardly. The plate 110 can move upwardly or downwardly against the side plate 102 and side of the upper assembly 64. Extending downwardly from the upper stage 110 and secured thereto is the upper roller bracket 112 and the upper roller 114. It is seen that the upper roller engages the top side of the flange 48. This upper roller and adjustment mechanism that maintains the positioning between the lower surface of the fixed plate 66 and the upper surface of flange 48.

It is seen that the upper roller assembly has some vertical adjustability due to the spring 74 which may permit the rod 70 to move vertically upwardly or downwardly. The position of the upper plate assembly can also be achieved in a coarse sense by the positioning of the nut 98 and 100 on the rod 70 but there is some flexibility in its positioning.

In operation, the valve body 20 rotates and receives gas from the inlet 12 and directs gas from the inlet through an aperture such as 46 to the remainder of the oxidizer. Treated gas is received in the rotary valve body through the apertures 42 and 44. Gas from the aperture 42 flows to the outlet 14 and gas from the aperture 44 flows through the valve body to the purge outlet 16. In its rotation, the valve body is supported by the adjustment assemblies relative to the lower fixed surface 22 and upper surface 64.

It will be appreciated that it is necessary to adjust the various assemblies 24–38.

Referring only to the assembly 24, it is seen that the first adjustment could be to the lower roller whereby the valve body is positioned relative to the fixed lower surface 22. Then the upper assembly 64 is positioned relative to the valve body and flange 48. This is done with the nuts 98 and 100 and the threaded rod 70. Then the upper roller's 114 position is adjusted by the nuts 106 and 108.

It will be appreciated that the upper roller 114 is in effect spring biased under the action of spring 74, through the roller 114, bracket 112, plate 110, sleeve 104, nuts 106 and 108 and threaded rod 70. Thus, the position of the upper roller which limits the upward movement of the flange can be adjusted by the upper roller assembly. There is some plate movement as the valve body rotates due to the spring 74. The other spring 82 acts to bias the lower roller assembly, but does not affect the motion of the upper roller assembly.

Thus, by use of these adjustments the positioning of the lower fixed plate 22, upper assembly 64 and the valve body 20 relative one another is assured so as to assure gas flow and minimize leakage in particular at the seals 96, 60 and 62.

In principal, the upper and lower plates can be adjusted relative to one another. These adjustments are provided under a spring bias in order to allow for unusual events during rotation. The valve body is positioned between the upper and lower plates and is positioned relative to the lower fixed plate by the lower roller assembly. The valve body is positioned relative to the upper plate by the upper roller assembly.

Rather than these elements all being independent of each other, the rod 70 is used as a common member and is provided with the lower securement system nut 72, bias spring 74 and nut 76. The upper fixed plate is secured to the rod by the nut 98 and nut 100. Thus, the rod the system provides for the adjustment of the upper and lower plates relative to each other. The lower roller assembly for adjusting the valve body relative to the lower fixed plate is provided via the sleeve 88, spring 82, nuts 84 and 86, web 88, plate 90 and roller support 92 and 94. This, in effect adjusts the position of the valve body relative to the lower fixed plate. The positioning of the valve body relative to the upper plate is provided by the sleeve and nut system 104, 106 and 108, the plate 110, support 112 and roller 114. It is appreciated that the lower support for the value body minimizes downward movement of the valve body while the upper roller 114 minimizes upward movements of the valve body. The bias spring 74 and 82 permit some flexibility in the system assuming that such is needed because of unexpected conditions.

It will be appreciated that numerous changes and modifications can be made to the embodiment disclosed herein without departing from the spirit and scope of this invention.

I claim as my invention:

1. A system for use in a regenerative thermal oxidizer comprising a rotatable valve body between and relative to an upper surface and a fixed lower surface of said regenerative thermal oxidizer so as to direct gas flow in a substantially leak-free manner between the lower surface, the valve body and the upper surface, said rotatable valve body being cylindrically shaped and rotatable about a cylinder axis, having upper and lower face portions for contacting said upper and lower surfaces, and having an external, circumferential, radially extending flange-like supporting member;

said upper surface constructed and arranged to engage and seal to said upper face of the rotatable valve body;

said lower surface constructed and arranged to engage and seal to said lower face of the rotatable valve body;

a plurality of adjustment assemblies spaced about the valve body and engaging the support flange;

each adjustment assembly secured to the fixed lower surface;

each adjustment assembly having a first mechanism for engaging the flange-like supporting member to position the valve body relative to the lower surface;

each adjustment assembly having a second mechanism for positioning the upper surface relative to the lower surface; and each adjustment assembly having a third mechanism for engaging the support member to position the valve body relative to the upper surface.

2. A system as in claim 1 wherein the first mechanism includes an elongated rod biasedly secured to the lower surface and extending upwardly therefrom toward the upper surface and having thereon an upwardly biased assembly for supporting a lower roller which contacts the lower surface of the flange member.

3. A system as in claim 2 wherein the extent of the downward movement of the support assembly is limited by a stop member associated with the threaded rod and the extent of the upward movement of the support member is controlled by a stop member associated with the rod.

4. A system as in claim 3 wherein the support is positioned between the upper and lower stop member.

5. A system as in claim 4 wherein the support member include a tubular member arranged to surround the rod and move upwardly and downwardly thereon between the upper and lower stop member, a general horizontal support stage connected to the tubular means, a roller bracket connected to the support, a roller associated with the bracket which contacts the flange.

6. A system as in claim 2 wherein said second mechanism includes a connection between the upstanding rod associated with the lower surface and the upper surface which is connected between a lower stop member and an upper stop member to the rod to be positioned therebetween and rest on the lower stop member.

7. A system as in claim 1 wherein the third support mechanism includes a support member movably secured to and surrounding said rod which includes a roller support and a downwarding extending upper roller for engaging said flange.

8. A system as in claim 7 wherein said upper support includes a cylindrical sleeve mounted to the thread and threadably secured thereto and having a horizontal support surface movably secured thereto and a downwardly extending roller.

9. A system for use in a regenerative thermal oxidizer to position a rotatable valve body between and relative to an upper surface and a fixed lower surface so as to direct gas flow in a substantially leak-free manner between the lower surface, the valve body and the upper surface, said rotatable valve body being cylindrically shaped and rotatable about a cylinder axis, having upper and lower face portions for contacting said upper and lower surfaces, and having an external, circumferential, radially extending flange-like supporting member;

said upper surface constructed and arranged to engage and seal to said upper face of the rotatable valve body;

said lower surface constructed and arranged to engage and seal to said lower face of the rotatable valve body;

a plurality of adjustment assemblies spaced about the valve body and engaging the support flange;

each adjustment assembly secured to the fixed lower surface;

each adjustment assembly having a first mechanism for engaging the flange-like supporting member to position the valve body relative to the lower surface;

each adjustment assembly having a second mechanism for positioning the upper surface relative to the lower surface;

each adjustment assembly having a third mechanism for engaging the support member to position the valve body relative to the upper surface;

wherein the first mechanism includes an elongated rod biasedly secured to the lower surface and extending upwardly therefrom toward the upper surface and having thereon an upwardly biased assembly for supporting a lower roller which contacts the lower surface of the flange member;

wherein the extent of the downward movement of the support assembly is limited by a stop member associated with the threaded rod and the extent of the upward movement of the support member is controlled by a stop member associated with the rod;

wherein the support is positioned between the upper and lower stop member;

wherein the support member include a tubular member arranged to surround the rod and move upwardly and downwardly thereon between the upper and lower stop member, a general horizontal support stage connected to the tubular means, a roller bracket connected to the support, a roller associated with the bracket which contacts the flange;

wherein said second mechanism includes a connection between the upstanding rod associated with the lower surface and the upper surface which is connected between a lower stop member and an upper stop member to the rod to be positioned therebetween and rest on the lower stop member;

wherein the third support mechanism includes a support member movably secured to and surrounding said rod which includes a roller support and a downwarding extending upper roller for engaging said flange; and wherein said upper support includes a cylindrical sleeve mounted to the thread and threadably secured thereto and having a horizontal support surface movably secured thereto and a downwardly extending roller.

* * * * *